US007804510B2

(12) United States Patent
Kleckner

(10) Patent No.: US 7,804,510 B2
(45) Date of Patent: Sep. 28, 2010

(54) IMAGING METHOD FOR UNIVERSAL PRINTERS USING AN IMAGE-ON-IMAGE PROCESS

(75) Inventor: Robert J. Kleckner, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 1106 days.

(21) Appl. No.: 11/458,327

(22) Filed: Jul. 18, 2006

(65) Prior Publication Data

US 2008/0019719 A1 Jan. 24, 2008

(51) Int. Cl.
*B41J 2/385* (2006.01)
*B41J 2/435* (2006.01)
*B41J 2/47* (2006.01)

(52) U.S. Cl. ..... 347/129; 347/117; 347/118; 347/232; 347/234; 347/248

(58) Field of Classification Search ..... 347/118, 347/129, 232, 234, 248
See application file for complete search history.

(56) References Cited

U.S. PATENT DOCUMENTS 2,297,691 A 10/1942 Carlson
6,456,310 B1 * 9/2002 Wallace et al. ..... 347/116
6,671,479 B2 12/2003 Grenek et al.

* cited by examiner

*Primary Examiner*—Matthew Luu
*Assistant Examiner*—Kendrick X Liu
(74) *Attorney, Agent, or Firm*—Oliff & Berridge, PLC

(57) ABSTRACT

A method of printing using an image-on-image device that includes a photoreceptor, including monochrome exposing the photoreceptor or monochrome charging the photoreceptor, wherein monochrome exposing the photoreceptor includes charging the photoreceptor, successively exposing the photoreceptor in a monochrome mode using a plurality of exposing devices during a single revolution of the photoreceptor relative to the exposing devices, and developing a monochrome image on the photoreceptor; and monochrome charging the photoreceptor includes successively charging the photoreceptor via a plurality of charging devices during a single revolution of the photoreceptor relative to the charging devices, exposing the photoreceptor using an exposing device, and developing an image on the photoreceptor. A marking device capable of implementing the method of printing.

10 Claims, 7 Drawing Sheets

IMAGING METHOD FOR UNIVERSAL PRINTERS USING AN IMAGE-ON-IMAGE PROCESS

BACKGROUND

In electrophotographic printing, a photoconductive surface is charged, and is then exposed to image data to selectively discharge portions of the charged photoconductive surface. This forms a latent electrostatic image on the photoconductive surface. Charged toner material is then applied to the latent-image-bearing portion of the photoconductive surface to convert the latent electrostatic image into a developed image.

In image-on-image electrophotographic printing systems, this process is repeated a number of times to build a multi-layer image. Typically, each layer of the multi-layer image is one color separation. Together, these separations form a developed color image comprised of toner. This developed, or toner, image is then transferred, either directly, or indirectly via a transfer member, to a sheet of recording material. The developed, or toner, image is then at least semi-permanently fixed to the sheet of recording material. An example of this process is more fully described in U.S. Pat. No. 2,297,691.

In the image-on-image technique, the photoconductive member passes through the first charge/expose/develop station. A toned image is created on the photoconductive surface in a color corresponding to the color of toner contained in the first station. The image bearing member, containing this first toned image, then moves to a second charge/expose/develop station. The latent image for the second separation is created by exposing the photoconductor through the toned image from the first separation. Subsequent latent images are exposed through the image or images formed prior, on the same portion of the photoconductive surface, and then developed.

Different color features of an input image are formed at separate stations of the image forming device. Each station typically contains a charging substation, an exposing substation and a developing station. These stations and substations are arranged around, and can be strategically spaced relative to, the photoconductive surface. Thus, in such image forming devices, the photoconductive surface may be a photoconductive belt. The speed that the belt moves past these different stations can be strategically set to allow adequate time for: 1) uniform charging of the photoconductive surface, 2) sufficient exposing of the latent image and 3) sufficient developing of the image.

Commercial demands require reliable, high-speed production of quality images. Most image forming devices are capable of printing about 40-80 pages per minute. More sophisticated image forming devices can print up to 100 pages per minute or more. An example of such devices is described in U.S. Pat. No. 6,671,479.

SUMMARY

Various exemplary embodiments of the systems and methods provide a method of printing using an image-on-image device that includes a photoreceptor, including at least one of monochrome exposing the photoreceptor and monochrome charging the photoreceptor, wherein monochrome exposing the photoreceptor includes charging the photoreceptor, successively exposing the photoreceptor in a monochrome mode using a plurality of exposing devices during a single revolution of the photoreceptor relative to the exposing devices, and developing a monochrome image on the photoreceptor; and monochrome charging the photoreceptor includes successively charging the photoreceptor via a plurality of charging devices during a single revolution of the photoreceptor relative to the charging devices, exposing the photoreceptor using an exposing device, and developing an image on the photoreceptor.

Various exemplary embodiments of the systems and methods also provide a marking device, that includes a movable photoreceptor, at least one of a multi-exposing marking device and a multi-charging marking device, wherein the multi-exposing marking device includes a charging device configured to charge the photoreceptor, a controller that controls a plurality of exposing devices configured to successively expose the photoreceptor using the plurality of exposing devices during one revolution of the photoreceptor during monochrome marking as the photoreceptor moves through the printing device, and a developing device that develops an image on the movable photoreceptor; and the multi-charging marking device includes a controller that controls a plurality of charging devices configured to successively charge the photoreceptor using the plurality of charging devices during one revolution of the photoreceptor during monochrome marking as the photoreceptor moves through the printing device, an exposing device that exposes the charged photoreceptor, and a developing device that develops an image on the charged and exposed photoreceptor.

BRIEF DESCRIPTION OF THE DRAWINGS

Various exemplary embodiments of systems and methods will be described in detail, with reference to the following figures, wherein.

DETAILED DESCRIPTION OF EMBODIMENTS

Various features and advantages are described in, or are apparent from, the following detailed description of various exemplary embodiments of the systems and methods.

Figure 1:
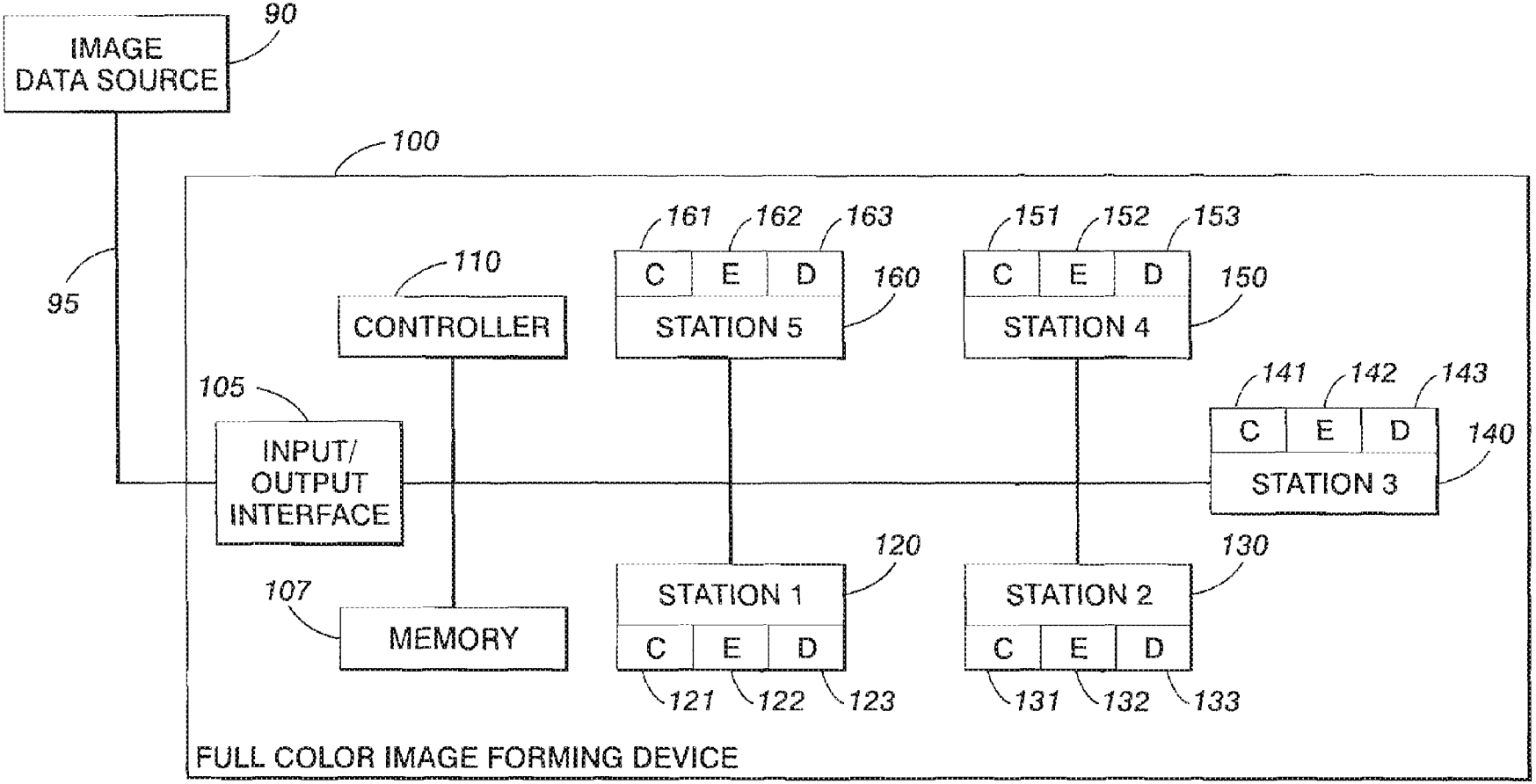
FIG. 1 (PRIOR ART)
FIG. 1 is a generalized block diagram of a conventional image forming device 100.

FIG. 1 is a generalized block diagram of a conventional image forming device 100. The image forming device 100 is connectable to an image data source 90 over a signal line or link 95. The image data source 90 provides input image data to the image forming device 100.

In general, the image data source 90 can be any one or more of a number of different sources, such as a scanner, a digital copier, a facsimile device that is suitable for generating electronic image data, or a device suitable for storing and/or transmitting electronic image data, such as a client or server of a network, such as the Internet, and especially the World Wide Web, for example. Thus, the image data source 90 can be any known or later-developed source that is capable of providing image data to the image forming device 100. The signal line or link 95 can be implemented using a public switched telephone network, a local or wide area network, an intranet, the Internet, a wireless transmission channel, or any other known or later-developed distributed network, or the like.

When the image data source 90 is a personal computer, the link 95 connecting the image data source 90 to the image forming device 100 can be a direct link between the personal computer and the image forming device 100. The link 95 can also be a local area network, a wide area network, the Internet, an intranet, or any other distributed processing and storage network. Moreover, the link 95 can also be a wireless link to the image data source 90. Accordingly, it should be appreciated that the image data source 90 can be connected using any known or later-developed system that is capable of transmitting data from the image data source 90 to the image forming device 100.

The image data provided by the image data source 90 is received by the input/output interface 105. The image data from the input/output interface 105, under the control of the controller 110, is forwarded either directly to the appropriate station or is initially stored in the memory 107. If the image data first is stored in the memory 107, the controller 110 can subsequently forward the image data from the memory 107 to the appropriate station.

The memory 107 can be implemented using any appropriate combination of alterable, volatile or non-volatile, memory; or non-alterable or fixed memory. The alterable memory, whether volatile or non-volatile, can be implemented using any one or more of static or dynamic RAM, a floppy disk and disk drive, a writeable or re-writeable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like.

It should be appreciated that, while the electronic image data can be generated at the time of printing an image from an original physical document, the electronic image data could have been generated at any time in the past. Moreover, the electronic image data need not have been generated from the original physical document, but could have been created from scratch electronically. The image data source 90 is thus any known or later developed device which is capable of supplying electronic image data over the link 95 to the image forming device 100. The link 95 can thus be any known or later developed system or device for transmitting the electronic image data from the image data source 90 to the image forming device 100.

A known image forming device prints cyan, magenta, yellow and black. These four colors are typically generated separately at stations 2-5, 130-160, respectively. Station 120 may be used for a custom color toner, or not at all. If station 120 is not used, it may still be retained in the architecture of the image forming device. Substations for charging, exposing and developing the different color images are located in each of stations 1 (121-123, respectively), station 2 (131-133, respectively), station 3 (141-143, respectively), station 4 (151-153, respectively) and station 5 (161-163, respectively).

Figure 2:
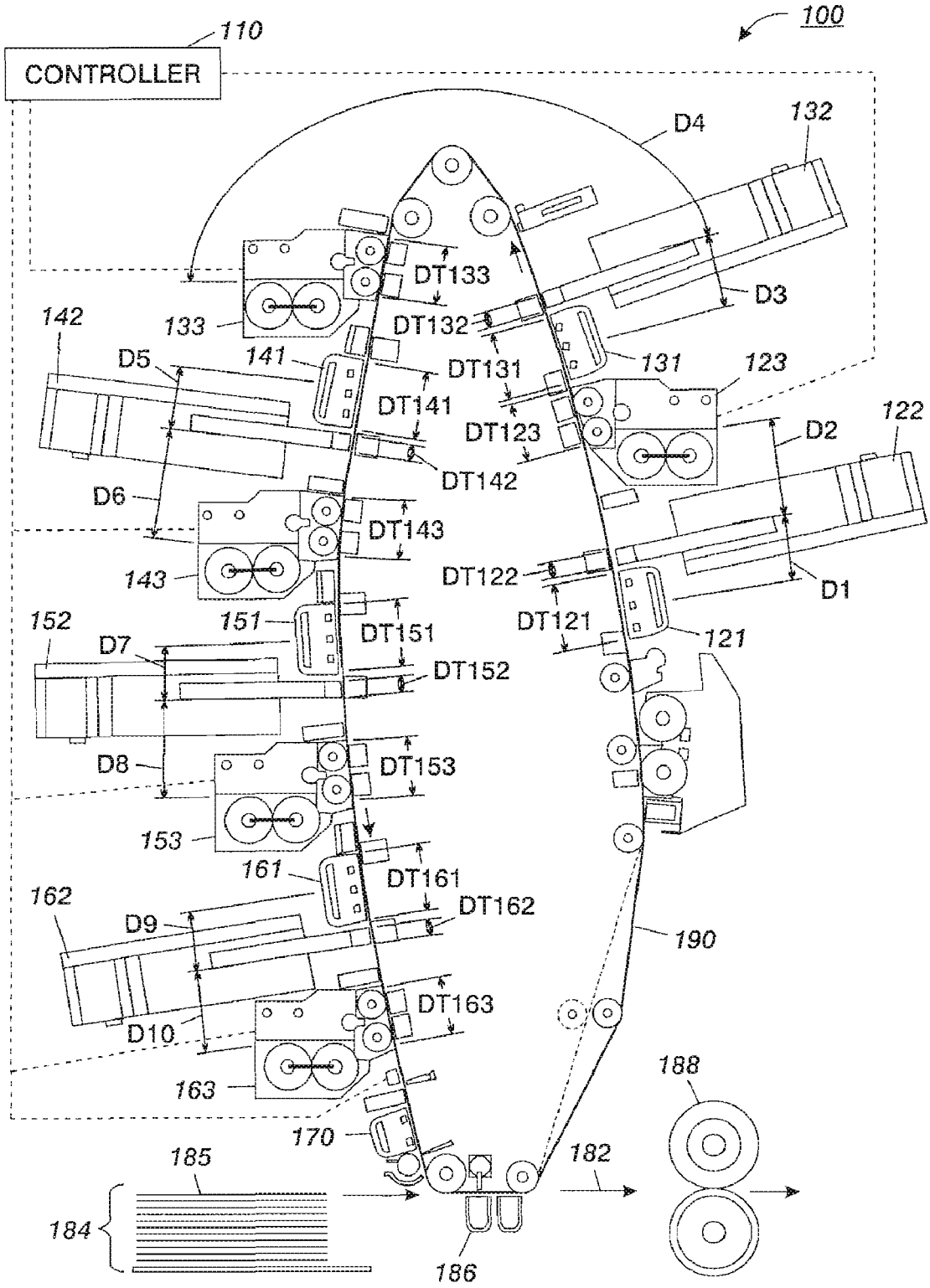
FIG. 2 (PRIOR ART)
FIG. 2 is a schematic diagram of an exemplary image forming device.

FIG. 2 is a schematic diagram of an exemplary image forming device. The photoconductive belt 190 moves, in a counterclockwise direction, through the various substations located along the circumference of the photoconductive belt 190. The charging substation 121 charges the photoconductive belt 190. The charged photoconductive belt 190 travels a distance DT121 through the charging substation 121. The charged photoconductive belt 190 then travels a distance D1 to reach the exposing substation 122. In various exemplary embodiments, the speed of the photoconductive belt 190 and the distance D1 between the exposing substation 122 and the charging substation 121 are predetermined to allow uniform charging of the portion of the photoconductive belt 190.

The exposing substation 122 exposes a portion of the photoconductive belt 190 in an image-wise fashion corresponding to the image associated with a first color separation. The portion of the photoconductive belt 190 travels a distance DT122 through the exposing substation 122. The portion of the photoconductive belt 190 then travels a distance D2 to reach the developing station 123. In various exemplary embodiments, the speed of the photoconductive belt 190 and the distance D2 between the developing station 123 and the exposing substation 122 are predetermined to allow sufficient exposure of the portion of the photoconductive belt 190.

The developing station 123 develops the first color of the toner image. The portion of the photoconductive belt 190 travels a distance DT123 through the developing station 123. The speed of the photoconductive belt must allow sufficient development of the first color of the toner image over the distance DT123.

The photoconductive belt continues to move, in a counterclockwise direction, to the charging substation 131. The charging substation 131 charges the photoconductive belt 190, including the toner image from station 123 on its surface. The charged photoconductive belt 190 travels a distance DT131 through the charging substation 131. The charged photoconductive belt 190 then travels a distance D3 to reach the exposing substation 132. In various exemplary embodiments, the speed of the photoconductive belt 190 and the distance D3 between the exposing substation 132 and the charging substation 131 are predetermined to allow uniform charging of the portion of the photoconductive belt 190.

The exposing substation 132 exposes a portion of the photoconductive belt 190 in an image-wise fashion corresponding to the image associated with a second color separation. The second separation may be exposed through the previously developed toner image, if necessary. The portion of the photoconductive belt 190 travels a distance DT132 through the exposing substation 132. The portion of photoconductive belt 190 then travels a distance D4 to reach the developing station 133. In various exemplary embodiments, the speed of the photoconductive belt 190 and the distance D4 between the developing station 133 and the exposing substation 132 are predetermined to allow sufficient exposure of the portion of the photoconductive belt 190 through the previously exposed image.

The developing station 133 develops the second color toner image. The portion of the photoconductive belt 190 travels a distance DT133 through the developing station 133. The speed of the photoconductive belt must allow sufficient development of the second color toner image over the distance DT133.

The photoconductive belt continues to move, in a counterclockwise direction, to the charging substation 141. The substation 141 charges the photoconductive belt 190. The charged photoconductive belt 190 travels a distance DT141 through the charging substation 141. The charged photoconductive bet 190 then travels a distance D5 to reach the exposing substation 142. In various exemplary embodiments, the speed of the photoconductive belt 190 and the distance D5 between the exposing substation 142 and the charging substation 141 are predetermined to allow uniform charging the portion of the photoconductive belt 190.

The exposing substation 142 exposes a portion of the photoconductive belt 190 in an image-wise fashion corresponding to the image associated with a third color separation. The third color separation may be exposed through the previously developed toner images, if necessary. The portion of the photoconductive belt 190 travels a distance DT142 through the exposing substation 142. The portion of the photoconductive belt 190 then travels a distance D6 to reach the developing station 143. In various exemplary embodiments, the speed of the photoconductive belt 190 and the distance D6 between the developing station 143 and the exposing substation 142 are predetermined to allow sufficient exposure of the portion of the photoconductive belt 190 through the previously exposed images.

The developing station 143 develops the third color toner image. The portion of the photoconductive belt 190 travels a distance DT143 through the developing station 143. The speed of the photoconductive belt must allow sufficient development of the third color toner image over the distance DT143.

The photoconductive belt continues to move, in a counterclockwise direction, to the charging substation 151. The charging substation 151 charges the photoconductive belt 190. The charged photoconductive belt 190 travels a distance DT151 through the charging substation 151. The charged photoconductive belt 190 then travels a distance D7 to reach the exposing substation 152. In various exemplary embodiments, the speed of the photoconductive belt 190 and the distance D7 between the exposing substation 152 and the charging substation 151 are predetermined to allow uniform charging of the portion of the photoconductive belt 190.

The exposing substation 152 exposes a portion of the photoconductive belt 190 in an image-wise fashion corresponding to the image associated with a fourth color separation. The fourth color separation may be exposed through the previously developed toner image, if necessary. The portion of the photoconductive belt 190 travels a distance DT152 through the exposing substation 152. The portion of the photoconductive belt 190 then travels a distance D8 to reach the developing station 153. In various exemplary embodiments, the speed of the photoconductive belt 190 and the distance D8 between the developing station 153 and the exposing substation 152 are predetermined to allow sufficient exposure of the portion of the photoconductive belt 190 through the previously exposed images.

The developing station 153 develops the fourth color toner image. The portion of the photoconductive belt 190 travels a distance DT153 through the developing station 153. The speed of the photoconductive belt must allow sufficient development of the fourth color toner image over the distance DT153.

In this schematic diagram of one exemplary embodiment of the known image forming device 100 of FIG. 1, a fifth set of charging, exposing and developing stations are present to generate a fifth color toner image. In this exemplary embodiment, the photoconductive belt continues to move in a counterclockwise direction to the charging substation 161. The charging substation 161 charges the photoconductive belt 190. The charged photoconductive belt 190 travels a distance DT161 through the charging substation 161. The charged photoconductive belt 190 then travels a distance D9 to reach the exposing substation 162. In various exemplary embodiments, the speed of the photoconductive belt 190 and the distance D9 between the exposing substation 162 and the charging substation 161 are predetermined to allow uniform charging of the portion of the photoconductive belt 190.

The exposing substation 162 exposes a portion of the photoconductive belt 190, in an image-wise fashion corresponding to the image associated with a fifth color separation. The fifth color separation may be exposed through the previously developed toner image, if necessary. The portion of the photoconductive belt 190 travels a distance DT162 through the exposing substation 162. The portion of the photoconductive belt 190 then travels a distance D10 to reach the developing station 166. In various exemplary embodiments, the speed of the photoconductive belt 190 and the distance D10 between the developing station 166 and the exposing substation 162 are predetermined to allow sufficient exposure of the portion of the photoconductive belt 190 through the previously exposed images.

The developing station 166 develops the fifth color toner image. The portion of the photoconductive belt 190 travels a distance DT163 through the developing station 166. The speed of the photoconductive belt must allow sufficient development of the fifth color toner image over the distance DT163.

It should be appreciated that the rate at which the belt may move through the stations is a function of the time required at each substation (i.e., dwell time), the distance through each substation and the distance between the substations within a particular station.

It should also be appreciated that the fifth set of charging, exposing and developing stations are not absolutely required to generate the full-color image. These substations may be physically present and unused. In various exemplary embodiments, charging substation 121, exposing substation 122 and developing station 123 are the substations reserved for an optional fifth color.

Upon development of the image, the photoconductive belt 190 continues to move, in a counterclockwise direction, through the pre-transfer station 170. The pre-transfer station 170 prepares the image for transfer to a recording material 185 at the transfer station 186. The recording material 185 is fed by the recording material housing 184 to the transfer station 186, where the image is transferred from the photoconductive belt 190 to the recording material 185. The recording material 185 then moves in the direction of 182 to the fixing device 188. The fixing device 188 receives the recording material 185 and fixes, at least semi-permanently, the image onto the recording material 185.

Figure 3:
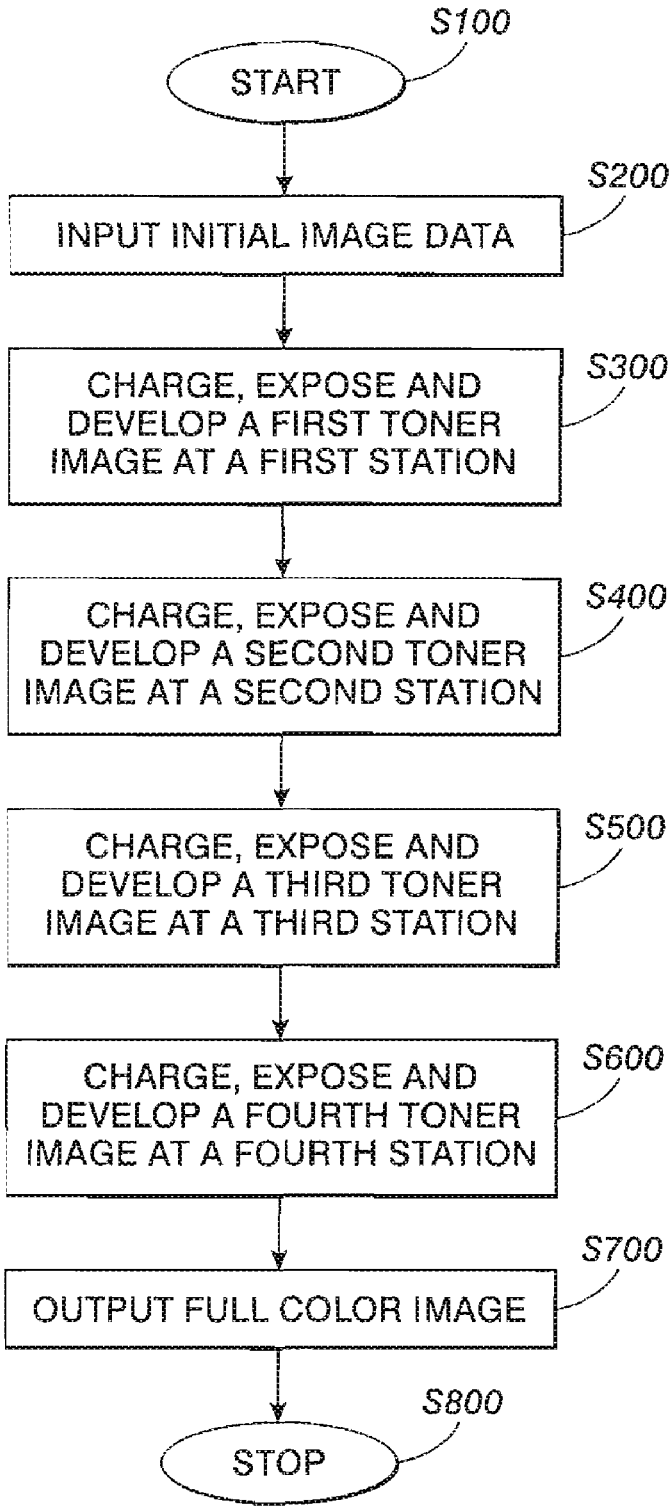
FIG. 3 (PRIOR ART)
FIG. 3 is a flowchart outlining a conventional method for generating images using an image forming device.

FIG. 3 is a flowchart outlining a conventional method for generating images using an image forming device. Beginning in step S100, the operation proceeds to step S200, where initial image data is input. Then, in step S300, the photoconductive surface is charged, exposed and a first color toner image is developed at a first station. Next, in step S400, the photoconductive surface is charged, exposed and a second toner color image is developed at a second station. Operation then continues to step S500.

In step S500, the photoconductive surface is charged, exposed and a third toner color image is developed at a third station. Then, in step S600, the photoconductive surface is charged, exposed and a fourth toner color image is developed at a fourth station. Next, in step S700, the final image is output. Operation of the method continue to step S800, where operation of the method stops.

Figure 4:
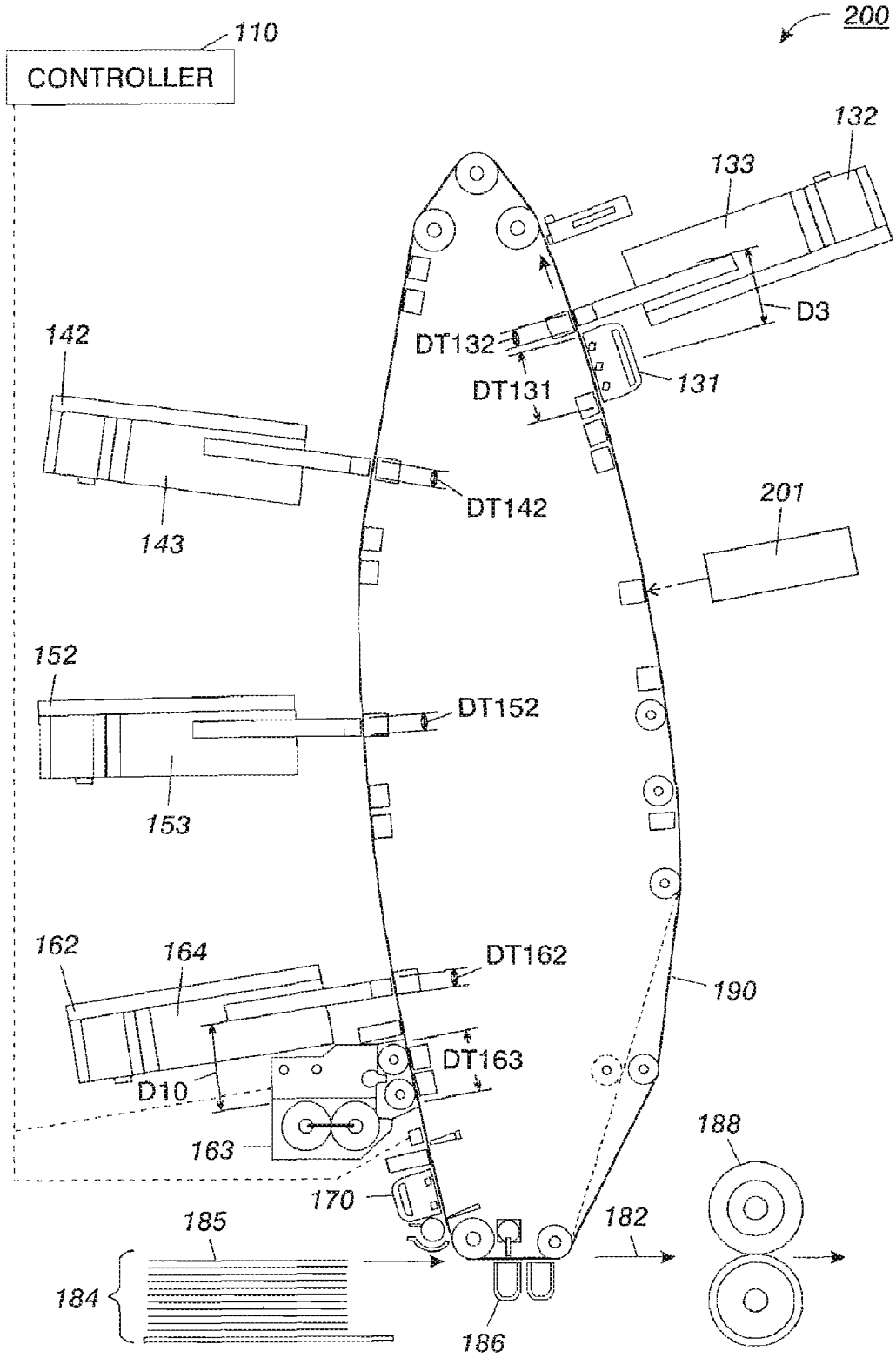
FIG. 4 is an illustration of an apparatus for generating images using an image forming device according to an exemplary embodiment.

FIG. 4 is a schematic diagram outlining one exemplary embodiment 200 of an image forming device for high speed monochrome printing. Under control of the controller 201, the photoconductive belt 190 moves, in a counterclockwise direction, through the various substations located along the circumference of the photoconductive belt 190. The photoconductive belt continues to move, in a counterclockwise direction, to the charging substation 131. The charging substation 131 charges the photoconductive belt 190. The charged photoconductive belt 190 travels a distance DT131 through the charging substation 131 to reach the exposing substation 132 where the photoconductive belt 190 is exposed, under control of the controller 201. In various exemplary embodiments, the speed of the photoconductive belt 190 and the distance D132 between the exposing substation 132 and the charging substation 131 are predetermined to allow uniform charging of the portion of the photoconductive belt 190 under control of the controller 201. According to various exemplary embodiments, the exposing substation 132 may include, but is not limited to, a raster output scanner (ROS) 133 that generates exposure light. Other methods of exposure familiar to those skilled in the art, such as light emitting diode (LED) bars, and the like, may also be used.

According to various exemplary embodiments, under control of the controller 201, the photoconductive belt may continue to move, in a counterclockwise direction, to the exposing substation 142 that includes the ROS 143, where the photoconductive belt 190 is again exposed in an image-wise fashion to a similar exposure pattern produced by exposure station 132, under control of the controller 201.

According to various exemplary embodiments, under control of the controller 201, the ROS 143 exposes a portion of the photoconductive belt 190, in an additive manner to the previously exposed latent image. The portion of the photoconductive belt 190 travels a distance DT142 through the exposing substation 142. In various exemplary embodiments, the speed of the photoconductive belt 190 may be predetermined to allow sufficient exposure of the portion of the photoconductive belt 190 through the previously exposed image.

According to various exemplary embodiments, under control of the controller 201, the photoconductive belt may continue to move, in a counterclockwise direction, to the exposing substation 152 that includes the ROS 153, where the photoconductive belt 190 is again exposed in an image-wise fashion to a similar exposure pattern produced by exposure station 132, under control of the controller 201. The portion of the photoconductive belt 190 travels a distance DT152 through the exposing substation 152.

In various exemplary embodiments, the photoconductive belt continues to move in a counterclockwise direction to the exposing substation 162 that includes the ROS 164, where the photoconductive belt 190 is again exposed in an image-wise fashion to a similar exposure pattern produced by exposure station 132, under control of the controller 201. The ROS 164 exposes, in an image-wise fashion, that portion of the photoconductive belt 190 containing the previously exposed latent images. The portion of the photoconductive belt 190 travels a distance through the exposing substation 162. The portion of the photoconductive belt 190 then travels a distance D10 to reach the developing station 166. In various exemplary embodiments, the speed of the photoconductive belt 190 and the distance D10 between the developing station 166 and the exposing substation 162 may be predetermined to allow sufficient exposure of the portion of the photoconductive belt 190 through the previously exposed images.

According to various exemplary embodiments, the exposing devices 132, 142, 152 and 162 are of similar exposure power and characteristics. Also according to various exemplary embodiments, the sum total of the exposing powers of the exposing devices 132, 142, 152 and 162 corresponds to the exposing power required to expose a monochrome image. This embodiment would not be limited, however, to systems whose sum total of the exposing powers of the exposing devices 132, 142, 152 and 162 corresponds to the exposing power required to expose a monochrome image. For example, an exemplary embodiment would also include any subset of exposing devices 132, 142, 152 and 162 should the subset possess the exposing power required to expose a monochrome image.

Under control of the controller 201, the developing station 166 develops the toner image. The portion of the photoconductive belt 190 travels a distance DT163 through the developing station 166. The speed of the photoconductive belt allows sufficient development of the toner image over the distance DT163.

It should be appreciated that the rate at which the belt may move through the stations is a function of the time required at each substation (i.e., dwell time) and the distance through each substation.

According to various exemplary embodiments, upon development of the image, the photoconductive belt 190 continues to move, in a counterclockwise direction, through the pre-transfer station 170, under control of the controller 201. The pre-transfer station 170 prepares the image for transfer to a recording material 185 at the transfer station 186. The recording material 185 is fed by the recording material housing 184 to the transfer station 186, where the image is transferred from the photoconductive belt 190 to the recording material 185. The recording material 185 then moves in the direction of 182 to the fixing device 188. The fixing device 188 receives the recording material 185 and fixes, at least semi-permanently, the image onto the recording material 185.

Figure 5:
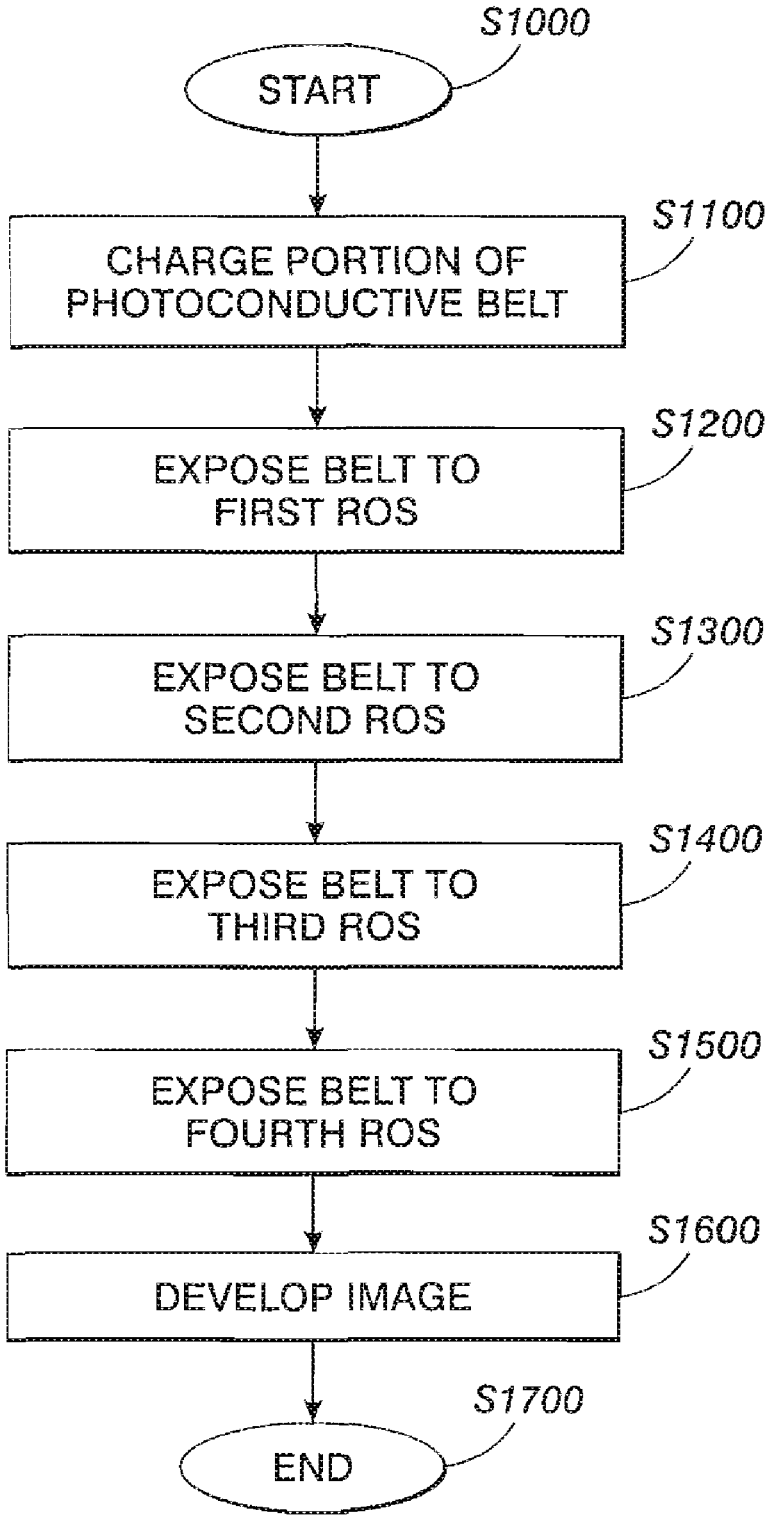
FIG. 5 is a flowchart outlining an exemplary method for generating images using an image forming device.

FIG. 5 is a flowchart outlining an exemplary method for generating images using an image forming device. The method starts in step S1000 and continues to step S1100, where the photoconductive belt is charged by a charging device. Next, control continues to step S1200, where the portion the photoconductive belt is being exposed to a first ROS. According to various exemplary embodiments, this first exposure corresponds to the exposure at the exposing device 132 of FIG. 4. Next, control continues to step S1300, where the portion of the photoconductive belt, circulating counterclockwise through the imaging device, is exposed to a second ROS. According to various exemplary embodiments, this second exposure corresponds to the exposure at the exposing device 142 of FIG. 4. Next, control continues to step S1400, where the portion of the photoconductive belt is exposed to a third ROS. According to various exemplary embodiments, this third exposure corresponds to the exposure at the exposing device 152 of FIG. 4. Next, control continues to step S1500, where the portion of the photoconductive belt is exposed to a fourth ROS. According to various exemplary embodiments, this fourth exposure corresponds to the exposure at the exposing device 162 of FIG. 4. Next, control continues to step S1600, where the image created on the portion of the photoconductive belt is developed. According to various exemplary embodiments, the development takes place at the developing station 166 of FIG. 4. Next, control continues to step S1700, where the method ends.

According to various exemplary embodiments, the photoreceptor belt may be exposed by two, three, four or more Raster Output Scanners (ROS). It should be noted that to one skilled in the art, the number of ROSs used for exposure, whether it is one, two, three, four or more, may be a function of, for example, the exposure power available per ROS, the speed at which the photoreceptor 109 moves, and the like. Generally, the faster the photoreceptor moves, the more light per unit time is required to expose it. Hence, by utilizing ROSs 133, 143 and 153, which, in the prior art illustrated in FIG. 1, would be idle during a monochrome printing process, it is possible to obviate the need to Increase the exposure power of ROS 164 when the printing system is operated at a higher process speed during a monochrome printing process.

Figure 6:
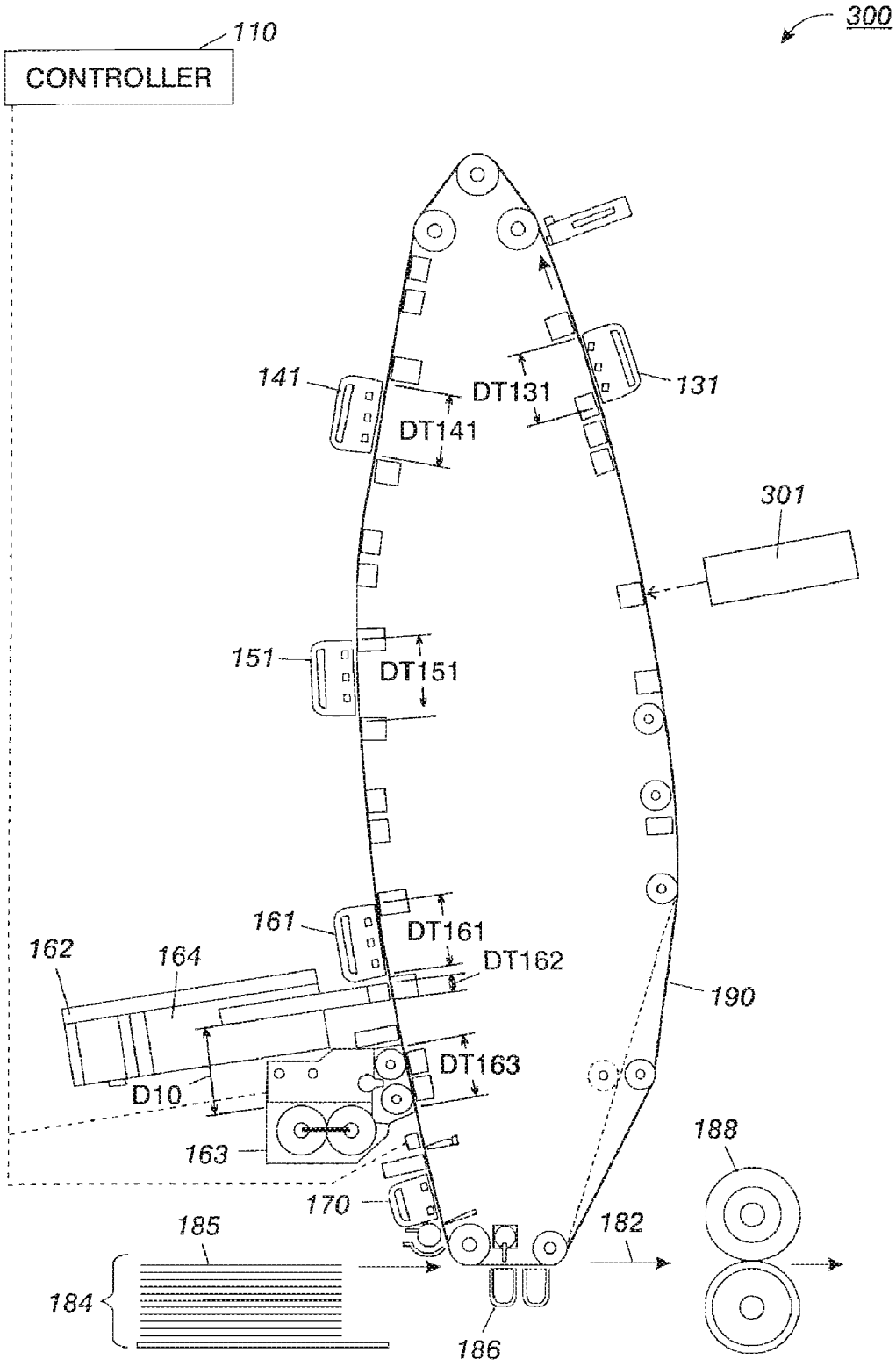
FIG. 6 is an illustration of an apparatus for generating images using an image forming device according to an exemplary embodiment.

FIG. 6 is an illustration of an apparatus 300 for generating images using an image forming device according to an exemplary embodiment. In FIG. 6, according to various exemplary embodiments, the photoconductive belt 190 moves, in a counterclockwise direction to the charging substation 131, where the photoconductive belt 190 is charged under control of the controller 301. The charged photoconductive belt 190 may then travel a distance DT131 through the charging substation 131. According to various exemplary embodiments, the charged photoconductive belt 190 then travels a distance to reach the second charging substation 141, where the substation 141 further charges the photoconductive belt 190 under control of the controller 301. During charging, the charged photoconductive belt 190 travels a distance DT141 through the charging substation 141. The charged photoconductive belt 190 may then travel a distance to reach the third charging substation 151, where the charging substation 151 charges the photoconductive belt 190 under control of the controller 301. During charging, the charged photoconductive belt 190 travels a distance DT151 through the charging substation 151. The charged photoconductive belt 190 may then travel a distance to reach the fourth charging substation 161, where the charging substation 161 charges the photoconductive belt 190 under control of the controller 301. During charging, the charged photoconductive belt 190 travels a distance DT161 through the charging substation 161. The charged photoconductive belt 190 may then travel a distance D9 to reach the exposing substation 162. In various exemplary embodiments, the speed of the photoconductive belt 190 and the distance D9 between the exposing substation 162 and the charging substation 161 are predetermined to allow uniform charging of the portion of the photoconductive belt 190.

The exposing substation 162 exposes a portion of the photoconductive belt 190 in an image-wise fashion corresponding to the monochrome image to be printed. The portion of the photoconductive belt 190 travels a distance DT162 through the exposing substation 162. The portion of the photoconductive belt 190 then travels a distance D10 to reach the developing station 163. The developing station 163 develops the monochrome toner image. The portion of the photoconductive belt 190 travels a distance DT163 through the developing station 163. The speed of the photoconductive belt must allow sufficient development of the toner image over the distance DT163.

It should be appreciated that the rate at which the belt may move through the stations is a function of the time required at each substation (i.e., dwell time), the distance through each substation and the distance between the substations within a particular station. Upon development of the image, the photoconductive belt 190 continues to move, in a counterclockwise direction, through the pre-transfer station 170. The pre-transfer station 170 prepares the image for transfer to a recording material 185 at the transfer station 186. The recording material 185 is fed by the recording material housing 184 to the transfer station 186, where the image is transferred from the photoconductive belt 190 to the recording material 185. The recording material 185 then moves in the direction of 182 to the fixing device 188. The fixing device 188 receives the recording material 185 and fixes, at least semi-permanently, the image onto the recording material 185.

Figure 7:
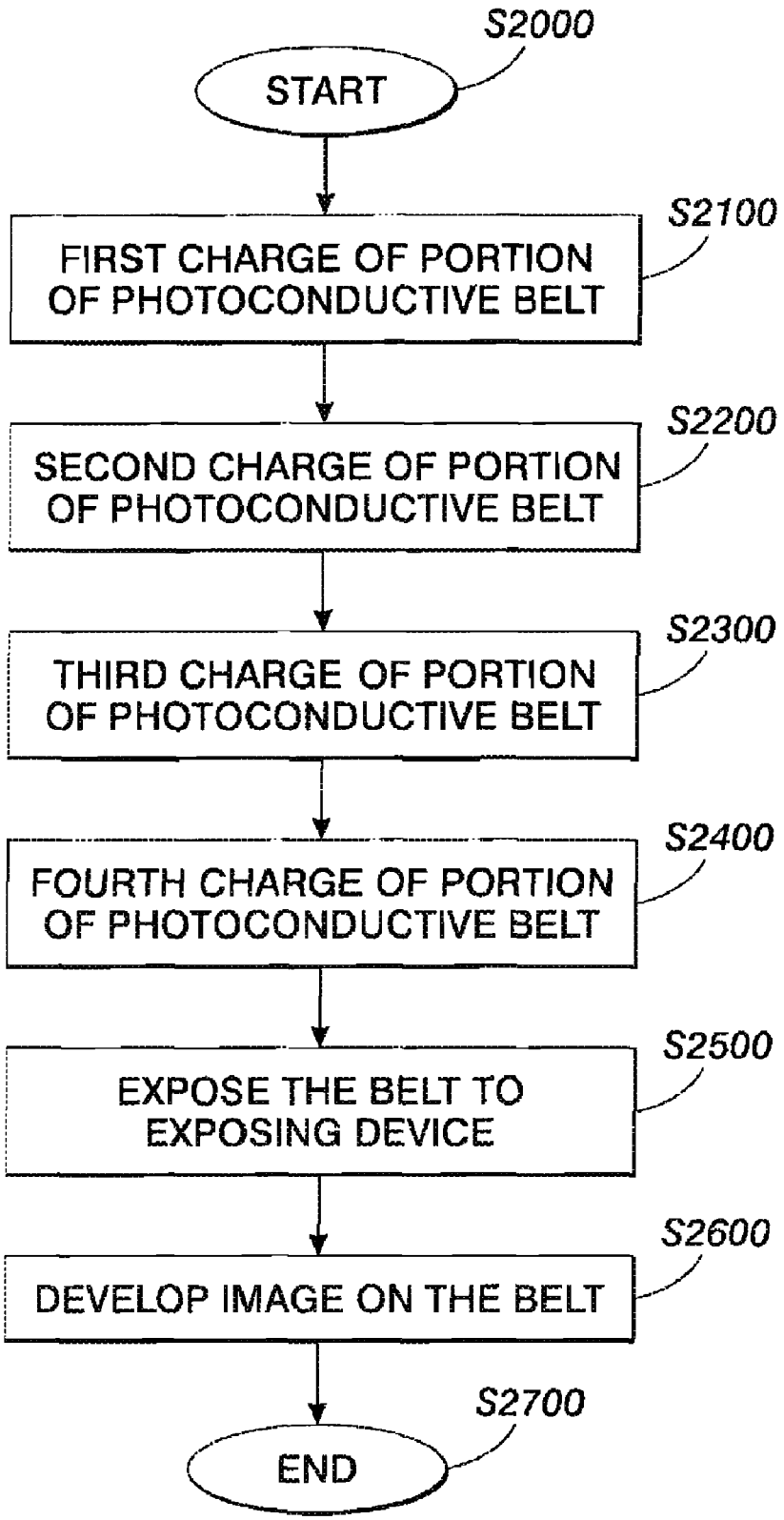
FIG. 7 is a flowchart outlining an exemplary method for generating images using an image forming device.

FIG. 7 is a flowchart outlining an exemplary method for generating images using an image forming device. The method starts in step S2000 and continues to step S2100, where a portion of the photoconductive belt is charged by a first charging device such as, for example, the charging device 131 of FIG. 6. Next, control continues to step S2200, where the portion the photoconductive belt is charged by a second charging device. According to various exemplary embodiments, during this step, the photoconductive belt moves counterclockwise and is charged by the charging device 141 of FIG. 6. Next, control continues to step S2300, where the portion of the photoconductive belt, circulating counterclockwise through the imaging device, is charged by a third charging device. According to various exemplary embodiments, the third charging is performed by the charging device 151 of FIG. 6. Next, control continues to step S2400, where the portion of the photoconductive belt is charged by a fourth charging device. According to various exemplary embodiments, this fourth charging is performed by the charging device 151 of FIG. 6. Next, control continues to step S2500, where the portion of the photoconductive belt is exposed to an exposing device. According to various exemplary embodiments, this exposure corresponds to the exposure at the exposing device 162 of FIG. 6. Next, control continues to step S2600, where the image created on the portion of the photoconductive belt is developed. According to various exemplary embodiments, the development takes place at the developing station 166 of FIG. 6. Next, control continues to step S2700, where the method ends.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of printing using an image-on-image device that includes a movable photoreceptor, comprising at least one of monochrome exposing of the photoreceptor and monochrome charging of the photoreceptor, wherein monochrome exposing of the photoreceptor comprises:

first, charging the photoreceptor;

second, successively exposing the photoreceptor in a monochrome mode using at least two exposing devices comprising one or more of raster output scanners and light emitting diode bars during a single revolution of the photoreceptor relative to the at least two exposing devices;

third, developing a monochrome image on the photoreceptor;

and monochrome charging the photoreceptor comprises:

fourth, successively charging the photoreceptor via a plurality of charging devices during a single revolution of the photoreceptor relative to the charging devices;

fifth, exposing the photoreceptor using the at least two exposing devices; and sixth, developing an image on the photoreceptor.

2. The method of claim 1, further comprising determining at least one of a travel speed and a travel distance in each exposing device to ensure a uniform exposure of the photoreceptor.

3. A marking device, comprising:

a movable photoreceptor; and at least one of a multi-exposing device and a multi-charging marking device;

the multi-exposing device comprising:

a charging device configured to charge the photoreceptor;

at least two exposing devices comprising one or more of raster output scanners and light emitting diode bars configured to second, expose the photoreceptor;

a first controller that controls the at least two exposing devices configured to third, successively expose the photoreceptor using the at least two exposing devices during one revolution of the photoreceptor during monochrome marking as the photoreceptor moves through the printing device; and a developing device that fourth develops an image on the photoreceptor; and the multi-charging marking device comprising:

a second controller that controls one or more charging devices configured to fifth, successively charge the photoreceptor using the one or more charging devices during one revolution of the photoreceptor during monochrome marking as the photoreceptor moves through the printing device; and a developing device that sixth, develops an image on the charged and exposed photoreceptor.

4. The device of claim 3, wherein each of the plurality of exposing devices comprises at least one of a raster output scanner and a light emitting diode bar.

5. The device of claim 3, wherein the photoreceptor comprises a photoconductive belt.

6. The device of claim 3, wherein the plurality of exposing devices have substantially equal power.

7. A printing apparatus using an image-on-image device that includes a photoreceptor, comprising at least one of means for monochrome exposing the photoreceptor and means for monochrome charging the photoreceptor, wherein: means for monochrome exposing the photoreceptor comprise:

means for first, charging the photoreceptor;

means for second successively exposing the photoreceptor in a monochrome mode using at least two exposing devices comprising one or more of raster output scanners and light emitting diode bars during a single revolution of the photoreceptor relative to the at least two exposing devices;

means for third, developing a monochrome image on the photoreceptor; and means of monochrome charging the photoreceptor comprising:

means for fourth, successively charging the photoreceptor via one or more charging devices of the photoreceptor relative to the charging devices during a single revolution;

means for fifth, exposing the photoreceptor using the at least two exposing devices; and means for sixth, developing an image on the photoreceptor.

8. The apparatus of claim 7, wherein the means for successively exposing the photoreceptor in a monochrome mode using a plurality of exposing devices comprises a plurality of exposing devices having equal power.

9. The apparatus of claim 7, wherein the means for exposing comprises at least one of a plurality of raster output scanners and a plurality of light emitting diode bars.

10. The apparatus of claim 7, further comprising means for determining at least one of a travel speed and a travel distance in each exposing device to ensure a uniform exposure of the photoreceptor.

* * * * *